United States Patent [19]

Walker

[11] 3,980,330

[45] Sept. 14, 1976

[54] SAFETY LATCH

[76] Inventor: Brooks Walker, 1280 Columbus Ave., San Francisco, Calif. 94133

[22] Filed: Dec. 9, 1974

[21] Appl. No.: 530,686

Related U.S. Application Data

[63] Continuation-in-part of Ser. No. 523,199, Nov. 13, 1974.

[52] U.S. Cl. ..... 292/262; 292/259 R; 70/93

[51] Int. Cl.[2] ..... E05C 17/04

[58] Field of Search ..... 292/259, 268, 262, 263; 70/93

[56] References Cited

UNITED STATES PATENTS

| | | | |
|---|---|---|---|
| 1,524,088 | 1/1925 | Ernst | 292/269 |
| 1,596,183 | 8/1926 | Horlick, Jr. | 292/268 X |
| 1,673,189 | 6/1928 | Frank et al. | 292/268 |

*Primary Examiner*—Richard E. Moore
*Attorney, Agent, or Firm*—Gordon Wood

[57] ABSTRACT

A safety latch for holding a door in its locked position or in a partially open position to enhance security. A bar for holding the door in either position is provided, together with a swingable keeper cooperating with the bar to perform the holding functions. The holding means for holding the bar in the door locked position is slidably supported on the bar for movement into and out of keeper holding position.

5 Claims, 10 Drawing Figures

Fig. 1.
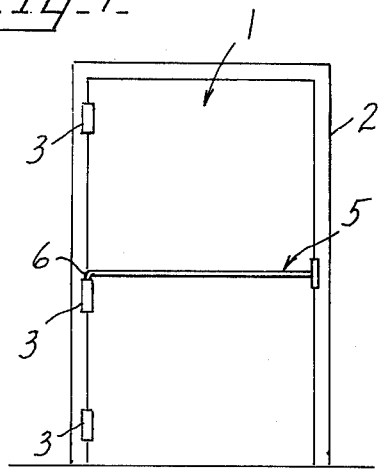
Fig. 2.
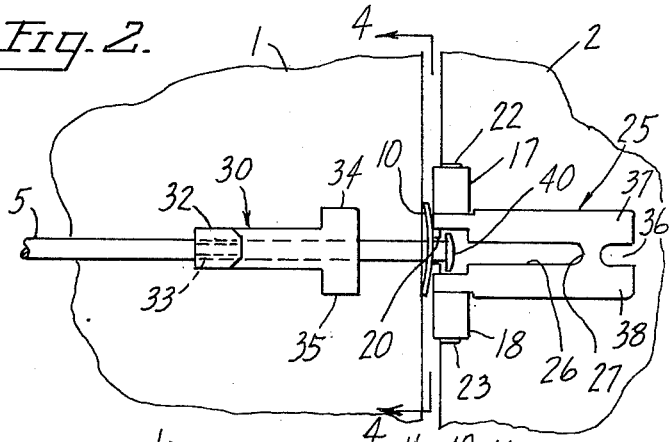
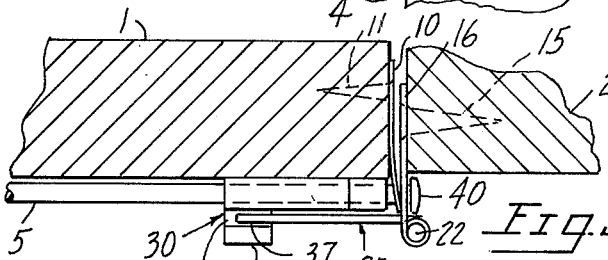
Fig. 3.
Fig. 4.
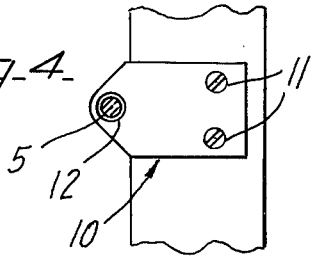
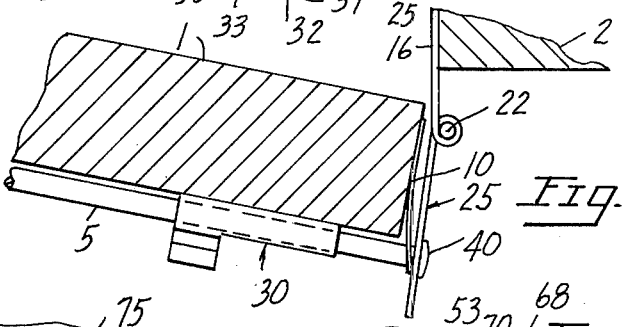
Fig. 5.
Fig. 6.
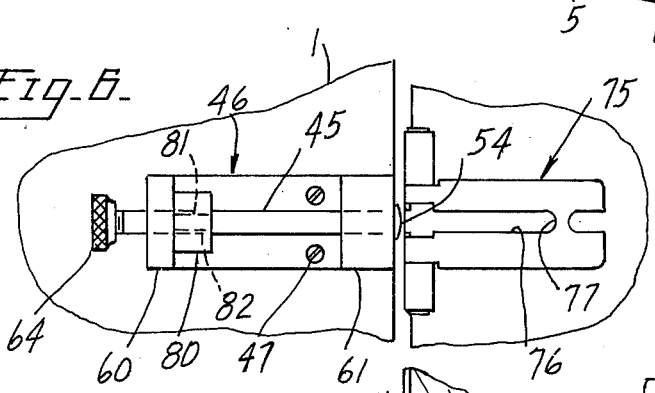
Fig. 7.
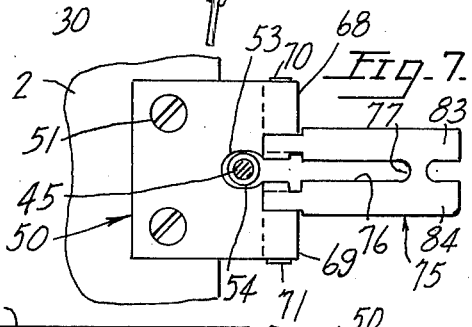
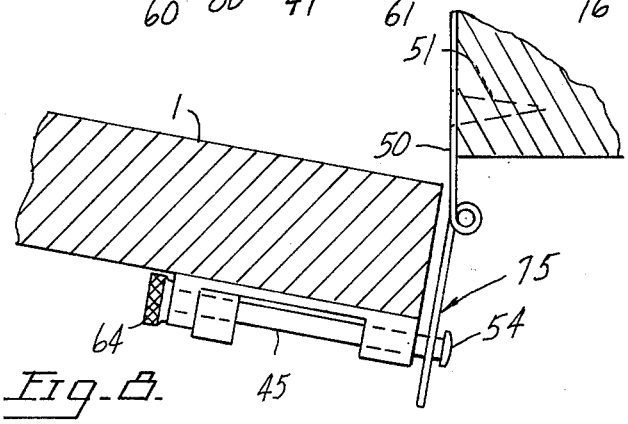
Fig. 8.
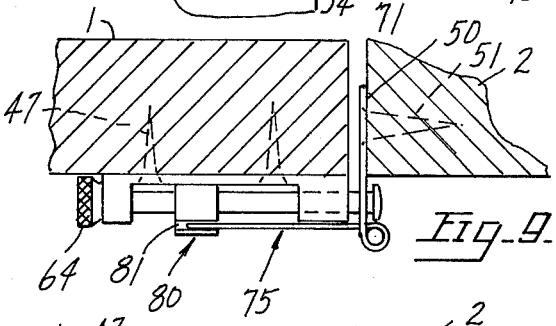
Fig. 9.
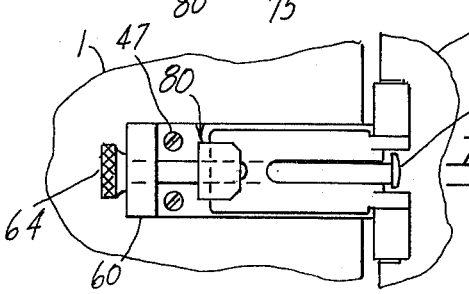
Fig. 10.

SAFETY LATCH

This invention is a continuation-in-part of application Ser. No. 523,199 filed Nov. 13, 1974.

This invention relates to a safety latch for holding a door in either a closed locked position or a partially opened position. When holding the door in closed position the bar provides additional security over that derived from the use of conventional door locks, latches, chains and the like. When holding the door in a partially opened position, it again provides security for the user and permits him to speak through the opening between the door and the frame without permitting the door to be swung past the partially opened position. Furthermore, the user can receive a letter or the like material through said opening.

The main object of the present invention is to provide a bar of the above described nature which is easily installed and which at the same time provides optimum security for the occupant of the house or apartment using the same.

Heretofore, it has been customary to provide a secondary door holding means in addition to the customary door lock or latch. Such prior art holding means has generally comprised a chain which is secured at one end to the door frame and adapted to be secured at its other end to a slotted member on the door to permit the door to be held in a partially opened position against further opening by a person outside the door. Such chain devices are characteristically weak in construction and the screws holding the chain attaching elements are usually placed in a manner so as not to provide a great amount of resistance against the door being pushed or kicked further open from the outside.

Another object of the invention is the provision of a door holding means which constitutes an improvement over the prior art in that the same is stronger than analogous devices heretofore available.

Other objects and advantages will be apparent from the following specification and from the drawings.

FIG. 1 is a side elevation of the interior side of a door structure showing the door and frame and the holding bar of one form of the invention cooperating therewith.

FIG. 2 is an enlarged fragmentary side elevation of the latch structure at the latch edge of the door showing the door closed but with the safety bar in open position with the keeper swung to inoperative position.

FIG. 3 is a horizontal cross section through the door and frame showing the structure of FIG. 2 but with the keeper and holding means in locked position when the door is closed.

FIG. 4 is a fragmentary side elevation of the door edge showing the support means for the locking bar of FIG. 2 and as taken in a plane indicated by lines 4—4 of FIG. 2.

FIG. 5 is a view similar to FIG. 3 but with the latch holding the door in partially open position.

FIG. 6 is a view similar to FIG. 2 showing a modified form of the invention.

FIG. 7 is an end elevation of the door frame showing the bar receiving plate secured thereto and with the keeper swung to a position permitting the door to be held in partially opened position.

FIG. 8 is a horizontal cross sectional view through the door and frame structure showing the keeper holding the door in partially opened position.

FIG. 9 is a horizontal cross sectional view similar to FIG. 8 but with the keeper holding the door in closed locked position.

FIG. 10 is a side elevation of the structure of FIG. 9.

Referring to FIG. 1, the invention is adapted to be used with a door generally designated 1 swingably mounted in a frame 2 by means of hinges 3. Extending horizontally across the door 1 is a holding bar generally designated 5 which may be formed at one end with a laterally offset portion 6. For the purpose of swingably mounting the bar 5 the hinge pin of the central hinge 3 may be removed so that said offset portion 6 can be received through the hinge knuckles.

The end of the bar 5 opposite the hinge 3 is supported by a plate 10 which, as best seen in FIG. 4, may be secured to the latch edge of the door by means of screws 11. The plate 10 extends outwardly past the inner face of the door and is formed with an aperture 12 for receiving the bar 5 therethrough. The plate 10 may be formed of sufficiently thin material and bent slightly as shown in FIGS. 3, 5 so that upon closing movement of the door, said plate is deformed toward a planar condition by the structure to be subsequently described.

Secured to the frame 2 by means of screws 15 is a plate 16 similar to a hinge plate and provided with upper and lower hinge knuckles 17 and 18 (see FIG. 2). Formed in plate 16 is an outwardly opening slot or opening 20 into which the bar 5 is adapted to be received as the door is moved to closed position. Swingably mounted on pins 22, 23 which are received in hinge knuckles 17, 18 is a keeper plate generally designated 25. This keeper plate 25 is formed with an elongated slot 26 which is in continuation of slot 20 in plate 16 when keeper plate 25 is swung into coplanar relationship with plate 16.

At this point it will be noted that keeper 25 does not present any interference to the movement of bar 5 into opening 20 in plate 16 as the door is being closed with the keeper 25 in the position shown in FIG. 2.

Slidably mounted on bar 5 is a holding device generally designated 30 which is formed with an outwardly projecting boss 32 provided with upper and lower slots 33 which are adapted to receive the outer end of keeper 25 therein. At the other end of holding device 30 are two ears 34, 35 adapted to fill the space between the door 1 and the keeper 25 near the edge of the door. Keeper 25 is formed adjacent its outer edge with an outwardly opening recess 36 thereby forming upper and lower tongues 37, 38, which, when the keeper is swung to the position of FIG. 3, may be received in slots 33 when the holding device 30 is moved to the right from the position of FIG. 2 to the position of FIG. 3. It will be noted from FIG. 3 that the door 1 is thus firmly secured against opening from its closed locked position.

When it is desired to secure the door against further opening from a partially opened position, the keeper 25 is swung to substantially coplanar relationship with plate 16 so that the end of bar 5 may be received in slot 26. When the bar 5 engages the inner end 27 of slot 26 no further opening movement of the door is permitted. In order to prevent the keeper 25 from separating from the bar 5, the latter is provided with an enlarged head 40 of a larger diameter than the width of slot 26 in the keeper 25.

A modified form of the invention is shown in FIGS. 6–10. In this case the locking bar 45 is relatively short and is supported in a support generally designated 46 which support is in turn secured to door 1 by means of screws 47 (FIG. 9). As best seen in FIG. 7, a plate 50 is secured by screws 51 to the frame 2 and is formed with an opening 53 for receiving bar 45 and its enlarged heat 54 therethrough.

The support 46 for bar 45 is formed with a pair of spaced apart ears 60, 61 which are provided with bores through which the bar 45 is slidably received. The end of bar 45 opposite enlarged head 54 is provided with a knob 64 which may be manually grasped for sliding the bar 45 from the inoperative position of FIG. 6 to the operative positions indicated in FIGS. 8, 10. When the latch is not to be used, the bar 45 and its head 54 may be retracted to the position of FIG. 6 so as not to catch on the clothing of a person passing through the doorway.

Plate 50 is provided at its outer edge with upper and lower hinge knuckles 68, 69 in which are received hinge pins 70, 71 respectively for swingably mounting a keeper generally designated 75. Keeper 75 is formed with an elongated slot 76 which is in alignment with opening 53 when the keeper 75 is substantially coplanar with plate 50. When it is desired to hold the door against further opening from a partially opened position, such as shown in FIG. 8, keeper 75 is swung to substantially the position shown in FIG. 8 and the door opened with the bar 75 in its projected position so that said bar may move along the length of slot 76 and abut against the inner end 77 thereof (FIG. 7).

Slidably supported on bar 45 between the ears 60 and 61 of support 46 is a holding element generally designated 80 which is formed with a pair of upper and lower slots 81, 82 which are adapted to receive therein upper and lower tongues 83, 84 formed on the outer end of keeper 75. Thus, as best seen in FIG. 9, when it is desired to lock the door in its closed position, keeper 75 is swung to the position of FIG. 9 and the holding element 80 is moved from its normal position shown in FIG. 6 to the keeper holding position shown in FIGS. 9, 10.

It will be noted that in both embodiments of the invention, security is always insured even when the door is being opened from its closed locked position to its partially opened position.

I claim:

1. In a door structure that includes a frame, and a door having a hinge edge and an opposite latch edge, a safety latch for holding said door against opening, comprising:

a bar supported on said door structure a plate mounted on said frame adjacent said latch edge of the door and disposed in a plane normal to the plane of said door, said plate being formed with an opening extending to the outer edge of said plate for receiving one end of said bar therethrough, a keeper swingably mounted relative to said frame and adapted to be swung from an inoperative position in opposed relation to said frame to an operative position substantially parallel to the plane of said door, holding means for holding said keeper in said operative position to prevent opening of said door, a support on said door adjacent the latch edge for supporting said bar, said support comprising a second plate secured to the latch edge of said door, said second plate extending outwardly from said door substantially at right angles thereto and being provided with an aperture receiving said bar therethrough.

2. In a door structure that includes a frame, and a door having a hinge edge and an opposite latch edge, a safety latch for holding said door against opening, comprising:

a bar supported on said door structure a plate mounted on said frame adjacent said latch edge of the door and disposed in a plane normal to the plane of said door, said plate being formed with an opening extending to the outer edge of said plate for receiving one end of said bar therethrough, a keeper swingably mounted relative to said frame and adapted to be swung from an inoperative position in opposed relation to said frame to an operative position substantially parallel to the plane of said door, holding means for holding said keeper in said operative position to prevent opening of said door, said holding means being slidably supported on said bar.

3. In a door structure that includes a frame, and a door having a hinge edge and an opposite latch edge, a safety latch for holding said door against opening, comprising:

a bar supported on said door structure a plate mounted on said frame adjacent said latch edge of the door and disposed in a plane normal to the plane of said door, said plate being formed with an opening extending to the outer edge of said plate for receiving one end of said bar therethrough.

a keeper swingably mounted relative to said frame and adapted to be swung from an inoperative position in opposed relation to said frame to an operative position substantially parallel to the plane of said door, holding means for holding said keeper in said operative position to prevent opening of said door, said bar being supported at one end in the hinge knuckles of one of the hinges supporting said door.

4. A latch according to claim 3 wherein said holding means is slidably supported by said bar.

5. A latch according to claim 1 wherein said holding means is supported by said bar.

* * * * *